US012736063B2

(12) United States Patent
Yamashita

(10) Patent No.: US 12,736,063 B2
(45) Date of Patent: Sep. 15, 2026

(54) BLOWER

(71) Applicant: NIDEC CORPORATION, Kyoto (JP)

(72) Inventor: Yushi Yamashita, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 0 days.

(21) Appl. No.: 19/339,681

(22) Filed: Sep. 25, 2025

(65) Prior Publication Data

US 2026/0092608 A1 Apr. 2, 2026

(30) Foreign Application Priority Data

Sep. 30, 2024 (JP) ..... 2024-170049
Apr. 24, 2025 (JP) ..... 2025-072556

(51) Int. Cl.
*F04D 29/52* (2006.01)
*F04D 19/02* (2006.01)

(52) U.S. Cl.
CPC ..... *F04D 29/522* (2013.01); *F04D 19/024* (2013.01)

(58) Field of Classification Search
CPC .... F04D 19/007; F04D 29/646; F04D 19/002; F04D 19/024; F04D 29/522; F04D 25/06; H05K 7/20172
See application file for complete search history.

(56) References Cited

U.S. PATENT DOCUMENTS 10,711,790 B2 * 7/2020 Hakozaki ..... F04D 29/544
2007/0081888 A1 * 4/2007 Harrison ..... F04D 19/007 257/E23.099
2008/0286135 A1 * 11/2008 Yoshida ..... F04D 29/544 417/423.5
2009/0226299 A1 * 9/2009 Jin ..... F04D 29/544 417/247

(Continued)

FOREIGN PATENT DOCUMENTS

JP 2008175099 A * 7/2008
TW 523652 B * 3/2003 ..... F04D 29/646

(Continued)

OTHER PUBLICATIONS

Machine translation of JP 2008175099 (Year: 2008).*

(Continued)

*Primary Examiner* — Brian O Peters
(74) *Attorney, Agent, or Firm* — Keating & Bennett, LLP

(57) ABSTRACT

A blower includes a pair of impellers, a pair of housings, a straightening grid, and a holding portion are included. The pair of impellers are rotatable with a central axis as a center, and are coaxial or substantially coaxial. The pair of housings extend along the central axis in a tubular shape with both end surfaces in an axial direction open, and respectively house the pair of impellers. The straightening grid is between the pair of impellers, and includes a plurality of ventilation passages that have a tubular shape and through which an airflow flows, the plurality of ventilation passages being (Continued)

arranged on a plane that intersects the plurality of ventilation passages in the axial direction. The holding portion is between the pair of housings, and holds a peripheral edge of the straightening grid. The straightening grid and the holding portion are made of different structures.

15 Claims, 13 Drawing Sheets

(56) References Cited

U.S. PATENT DOCUMENTS

| | | | | |
|---|---|---|---|---|
| 2011/0164384 | A1* | 7/2011 | Vogel | F28D 1/024 165/122 |
| 2014/0251583 | A1 | 9/2014 | Eriksen | |

FOREIGN PATENT DOCUMENTS

| | | | |
|---|---|---|---|
| TW | 1226410 | * | 1/2005 |
| TW | 1303291 | * | 11/2008 |

OTHER PUBLICATIONS

Machine translation of TW 523652 (Year: 2003).*
Machine translation of TW 1226410 (Year: 2005).*
Machine translation of TW 1303291 (Year: 2006).*

* cited by examiner

BLOWER

CROSS-REFERENCE TO RELATED APPLICATIONS

The present application claims priority under 35 U.S.C. § 119 to Japanese Patent Application No. 2024-170049, filed on Sep. 30, 2024, and Japanese Patent Application No. 2025-072556, filed on Apr. 24, 2025, the entire contents of which are hereby incorporated herein by reference.

1. FIELD OF THE INVENTION

The present disclosure relates to blowers.

2. BACKGROUND

A conventional blower includes a pair of impellers, a pair of housings, and a straightening grid. The pair of impellers are rotatable with a central axis as a center, and are coaxially disposed. The pair of housings extend along the central axis to be formed in a tubular shape with both end surfaces in an axial direction open, and respectively house the pair of impellers. The straightening grid is disposed between the pair of impellers, and includes a plurality of ventilation passages that has a tubular shape and through which an airflow flows, the plurality of ventilation passages being arranged on a plane that intersects the plurality of ventilation passages in the axial direction. The straightening grid is sandwiched and held by the pair of housings. However, in the conventional blower, it is difficult to position the straightening grid, and there has been a possibility of a deterioration in assembling workability.

SUMMARY

A blower according to an example embodiment of the present disclosure includes a pair of impellers, a pair of housings, a straightening grid, and a holding portion. The pair of impellers are rotatable with a central axis as a center, and are coaxially or substantially coaxially arranged. The pair of housings extend along the central axis and have a tubular shape with both end surfaces in an axial direction open, and respectively house the pair of impellers. The straightening grid is between the pair of impellers, and includes a plurality of ventilation passages that have a tubular shape and through which an airflow flows, the plurality of ventilation passages being arranged on a plane that intersects the plurality of ventilation passages in the axial direction. The holding portion is between the pair of housings, and holds a peripheral edge of the straightening grid. The straightening grid and the holding portion are made of different structures.

The above and other elements, features, steps, characteristics and advantages of the present disclosure will become more apparent from the following detailed description of the example embodiments with reference to the attached drawings.

DETAILED DESCRIPTION

Hereinafter, example embodiments of the present disclosure will be described in detail with reference to the drawings. Herein, a direction in which a central axis J of a blower 1 extends is simply referred to as an "axial direction", a direction that is orthogonal to the central axis J of the blower 1 with the central axis J as a center is simply referred to as a "radial direction", and a direction along a circular arc with the central axis J of the blower 1 as a center is simply referred to as a "circumferential direction". Furthermore, a section that is parallel to the axial direction is referred to as a "longitudinal section". The term "parallel" does not mean "parallel" in a strict sense, but includes "roughly parallel". The phrase "along the central axis J" means being parallel to the central axis J, and includes being roughly parallel to the central axis J.

Figure 1:
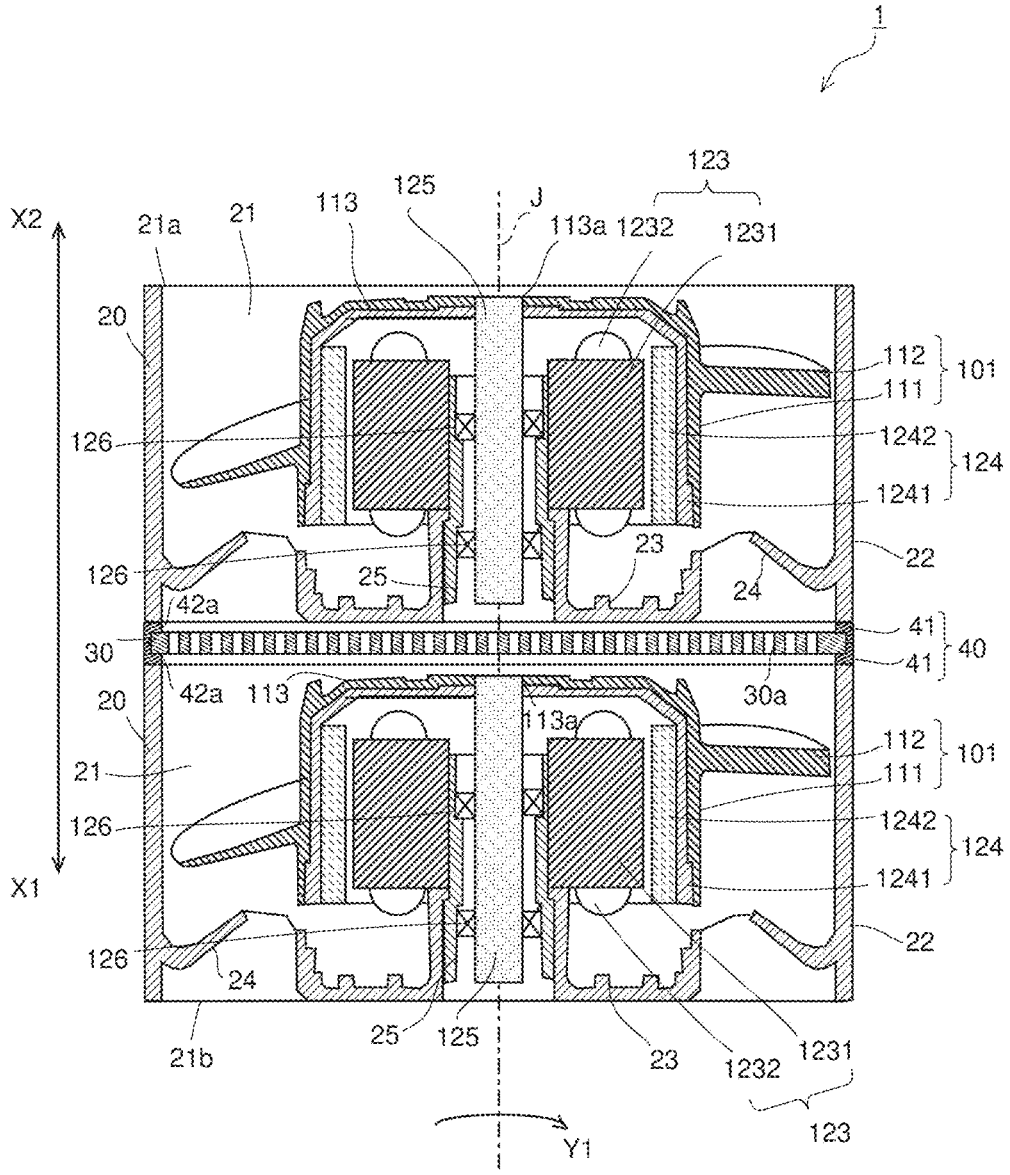
FIG. 1 is a longitudinal sectional view of a blower according to a first example embodiment of the present disclosure.

Moreover, for convenience of description, it is assumed that the axial direction is an upward/downward direction, and shapes of respective portions and a positional relationship among the respective portions will be described under the assumption that an upward/downward direction in FIG. 1 is an upward/downward direction of the blower 1. A "lower side" of the blower 1 is an "exhaust side", and an "upper side" is an "intake side". Note that this definition of the upward/downward direction does not restrict an orientation and a positional relationship of the blower when in use. Furthermore, herein, a section that is parallel to the axial direction is referred to as a "longitudinal section".

Figure 2:
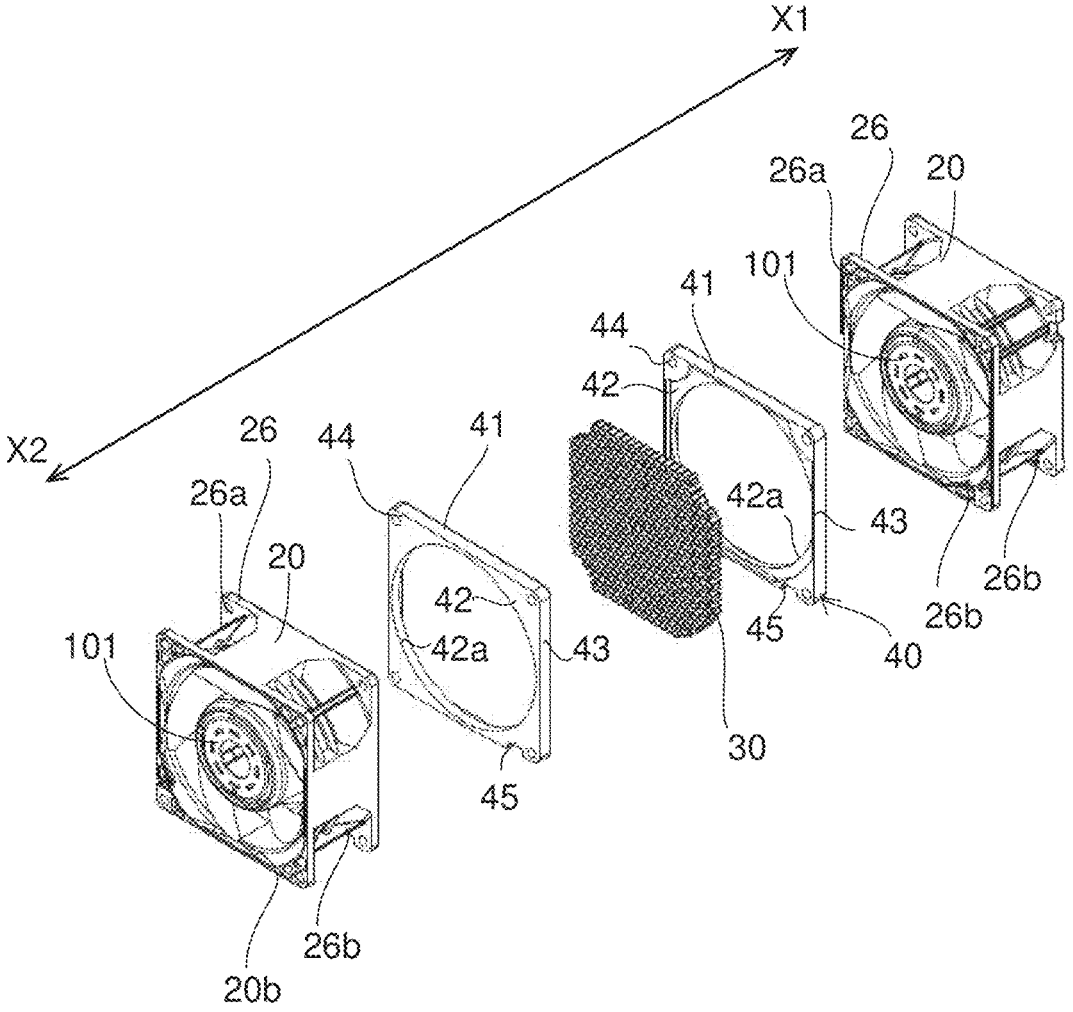
FIG. 2 is an exploded perspective view of the blower according to the first example embodiment of the present disclosure.

FIG. 1 is a longitudinal sectional view of an example of a blower 1 according to a first example embodiment of the present disclosure, and FIG. 2 is an exploded perspective view of the blower 1. The blower 1 includes a pair of impellers 101 that are disposed side by side in the axial direction, a pair of motors 12, a pair of housings 20, a straightening grid 30, and a holding portion 40. In the present example embodiment, the holding portion 40 is constituted by a pair of clamps 41 that clamp a peripheral edge of the straightening grid 30 in the axial direction (X1-X2).

The blower 1 generates an airflow from an axially upper side X2 to an axially lower side X1 along the central axis J. The pair of impellers 101 are rotatable with the central axis J as a center, and are coaxially disposed. The pair of motors 12 respectively rotate the impellers 101 around the central axis J. In the present example embodiment, the pair of impellers 101 rotate, for example, clockwise (in a Y1 direction) around the central axis J in a top view. Note that in the present example embodiment, the pair of impellers 101 have an identical shape, and rotate in an identical direction, but may have different shapes. Furthermore, the pair of impellers 101 may rotate in directions opposite to each other according to the shape.

Each of the housings 20 is a resin-molded article (a mold-molded article), and includes a blowing flow path 21. Each of the housings 20 houses the impeller 101, the motor 12, and a circuit board (not illustrated). The blowing flow path 21 extends along the central axis J inside the housing 20. The pair of housings 20 are coupled to each other in the axial direction, and the blowing flow paths 21 also communicate with each other in the axial direction. The pair of housings 20 that have been coupled include an exhaust port 21*b* at a lower end, and an intake port 21*a* at an upper end.

Although not illustrated, in each of the pair of housings 20, the internal blowing flow path 21 that faces the straightening grid 30 expands radially outward in a portion closer to the straightening grid 30 in the blowing flow path 21. This enables an airflow to be smoothly delivered from the impeller 101 disposed on an intake side X2 toward the straightening grid 30. In addition, the airflow straightened by the straightening grid 30 can be smoothly delivered toward the impeller 101 disposed on an exhaust side X1. This can improve blowing efficiency and quietness of the blower 1.

In the present example embodiment, the peripheral edge of the straightening grid 30 is clamped by the pair of clamps 41 in the axial direction (X1-X2), and is held. Furthermore, the pair of clamps 41 (the holding portion 40) that hold the peripheral edge of the straightening grid 30 are further clamped by the pair of housings 20 in the axial direction (X1-X2). At this time, the straightening grid 30 and the pair of clamps 41 (the holding portion 40) are made of different structures.

As a result, the straightening grid 30 that has been positioned in advance by the pair of clamps 41 (the holding portion 40) is clamped by the pair of housings 20, and therefore the blower 1 can be easily assembled. In addition, the pair of clamps 41 (the holding portion 40) can be detached from the pair of housings 20, and the straightening grid 30 can be easily replaced. Furthermore, the detached straightening grid 30 can be easily cleaned. Accordingly, it is possible to provide the blower 1 in which the straightening grid 30 can be easily positioned and assembling workability can be improved. In the present example embodiment, the holding portion 40 is constituted by the pair of clamps 41 that clamp the peripheral edge of the straightening grid 30 in the axial direction (X1-X2). As a result, the straightening grid 30 can be more easily positioned by being clamped by the pair of clamps 41.

The straightening grid 30 straightens an airflow to be delivered from the impeller 101 located on the intake side X2 to one side X1 in the axial direction. The straightened airflow is taken into the impeller 101 located on the exhaust side X1, and is discharged from the exhaust port 21*b*. In the airflow that has been straightened by the straightening grid 30, a swirling component decreases, and a component that flows in the axial direction increases. As a result, pressure and an air volume of the airflow to be delivered from the impeller 101 located on the exhaust side X1 increase. In addition, the quietness of the blower 1 is improved. Note that the straightening grid 30 and the clamp 41 will be described later in detail.

Each of the housings 20 includes a tubular wall 22, a base 23, a stator blade 24, a bearing holding portion 25, and a flange 26.

The tubular wall 22 extends along the central axis J, and covers the impeller 101 from a radially outer side. The tubular wall 22 has a cylindrical shape that extends axially upward and downward. Stated another way, the housing 20 has a cylindrical shape. The blowing flow path 21 is disposed radially inside the tubular wall 22. The intake port 21*a* is disposed at an axially upper end of the tubular wall 22 located on the intake side X2. The exhaust port 21*b* is disposed at an axially lower end of the tubular wall 22 located on the exhaust side X1.

The flange 26 protrudes radially outward from an axially outer end of the tubular wall 22, and includes a housing screw hole 26*a* that penetrates in the axial direction (X1-X2). The flange 26 is provided in four positions in each of an end located on one side X1 in the axial direction and an end located on another side X2 in the axial direction of each of the tubular walls 22.

Furthermore, the flange 26 includes a housing groove 26*b*. In the present example embodiment, the housing groove 26*b* is formed by causing an outer peripheral surface of the flange 26 to be recessed radially inward. The housing groove 26*b* is in a position that overlaps a groove 45 formed in the clamp 41 described later in the axial direction (X1-X2).

The motor 12 is fixed to the base 23. The base 23 has a disk shape that spreads in the radial direction with the central axis J as a center. In the present example embodiment, the base 23 is disposed on the exhaust side X1 in each of the housings 20.

The stator blade 24 extends radially outward from a radially outer surface of the base 23, and couples the base 23 to the tubular wall 22. A plurality of stator blades 24 is arranged in the circumferential direction. The air that flows through the blowing flow path 21 is straightened when passing between the adjacent stator blades 24, and flows to the axially lower side X1.

The bearing holding portion 25 is, for example, a metal member such as brass, and is molded integrally with the base 23. The bearing holding portion 25 has a cylindrical shape that protrudes in the axial direction from the base 23 with the central axis J as a center. In the present example embodiment, each of the bearing holding portions 25 protrudes from an upper surface of the base 23 toward the intake side X2.

The bearing holding portion 25 internally holds the bearing 126 described later, and constitutes a portion of the motor 12. Note that the bearing holding portion 25 may be molded integrally with the base 23 by using an identical resin member, instead of molding the bearing holding portion 25 by using a member that is different from the base 23.

The impeller 101 is rotatably supported by the motor 12 on a radially inner side of the tubular wall 22. The impeller 101 is a resin-molded article (a mold-molded article), and is rotated around the central axis J by the motor 12. The impeller 101 includes a barrel 111 having a tubular shape, and a plurality of blades 112. The barrel 111 is a roughly cylindrical member that includes a lid 113 on the axially upper side X2. The barrel 111 is fixed to a radially outer side of the rotor yoke 1241 described later, and is rotatable around the central axis J. The lid 113 includes a through-hole 113*a* that penetrates through the central axis J in the axial direction. For example, an upper end of a shaft 125 is inside the through-hole 113*a*.

The plurality of blades 112 protrudes in the radial direction from an outer peripheral surface of the barrel 111, and is disposed to be spaced apart from each other in the circumferential direction. The blades 112 rotate around the central axis J to send air to the axially lower side X1.

The motor 12 is fixed to the base 23, and is housed in the housing 20. The motor 12 includes the shaft 125, the bearing 126, the bearing holding portion 25, a stator 123, and a rotor 124.

The shaft 125 is disposed along the central axis J. The shaft 125 is a columnar member that is made of metal such as stainless steel, and extends axially upward and downward. The shaft 125 is supported by the bearing 126 to be rotatable around the central axis J.

The bearing 126 is held inside the bearing holding portion 25. The bearing 126 is constituted by, for example, a ball bearing, but may be constituted by a sleeve bearing or the like. A pair of axially upper and lower bearings 126 support the shaft 125 to be rotatable around the central axis J relative to the housing 20.

The stator 123 is fixed to an outer peripheral surface of the bearing holding portion 25. The stator 123 includes a stator core 1231, an insulator (not illustrated), and a coil 1232.

The stator core 1231 is formed by vertically stacking electromagnetic steel plates such as silicon steel plates. The insulator (not illustrated) is made of an insulating resin. The insulator (not illustrated) is provided on a portion of an outer surface of the stator core 1231. The coil 1232 is formed of a conductive wire that has been wound around the stator core 1231 with the insulator interposed therebetween.

The rotor 124 is disposed on a radially outer side of the stator 123. The rotor 124 rotates around the central axis J relative to the stator 123. The rotor 124 includes the rotor yoke 1241 and a magnet 1242.

The rotor yoke 1241 is made of a magnetic material, and the rotor yoke 1241 is a roughly cylindrical member including a lid on the axially upper side X2. The rotor yoke 1241 is fixed to the shaft 125. The magnet 1242 has a cylindrical shape, and is fixed to an inner peripheral surface of the rotor yoke 1241. The magnet 1242 is disposed on a radially outer side of the stator 123.

The circuit board (not illustrated) is disposed, for example, between the impeller 101 and the base 23. The circuit board has, for example, a disk shape that spreads in the radial direction with the central axis J as a center. The circuit board is electrically connected to a lead wire of the coil 1232. An electronic circuit configured to supply a driving current to the coil 1232 is mounted on the circuit board.

In the blower 1 having the configuration described above, when the driving current has been supplied to the coil 1232 of the motor 12 via the circuit board, a magnetic flux in the radial direction is generated in the stator core 1231. A magnetic field generated by the magnetic flux of the stator core 1231 and a magnetic field generated by the magnet 1242 act, and torque is generated in the circumferential direction of the rotor 124. This torque rotates the impeller 101 with the central axis J as a center. When the impeller 101 has rotated, the plurality of blades 112 generates an airflow. As a result, the blower 1 generates an airflow in which an upper side is the intake side (an upstream side in a blowing direction) X2 and a lower side is the exhaust side (a downstream side in the blowing direction) X1, and can perform blowing.

Figure 3:
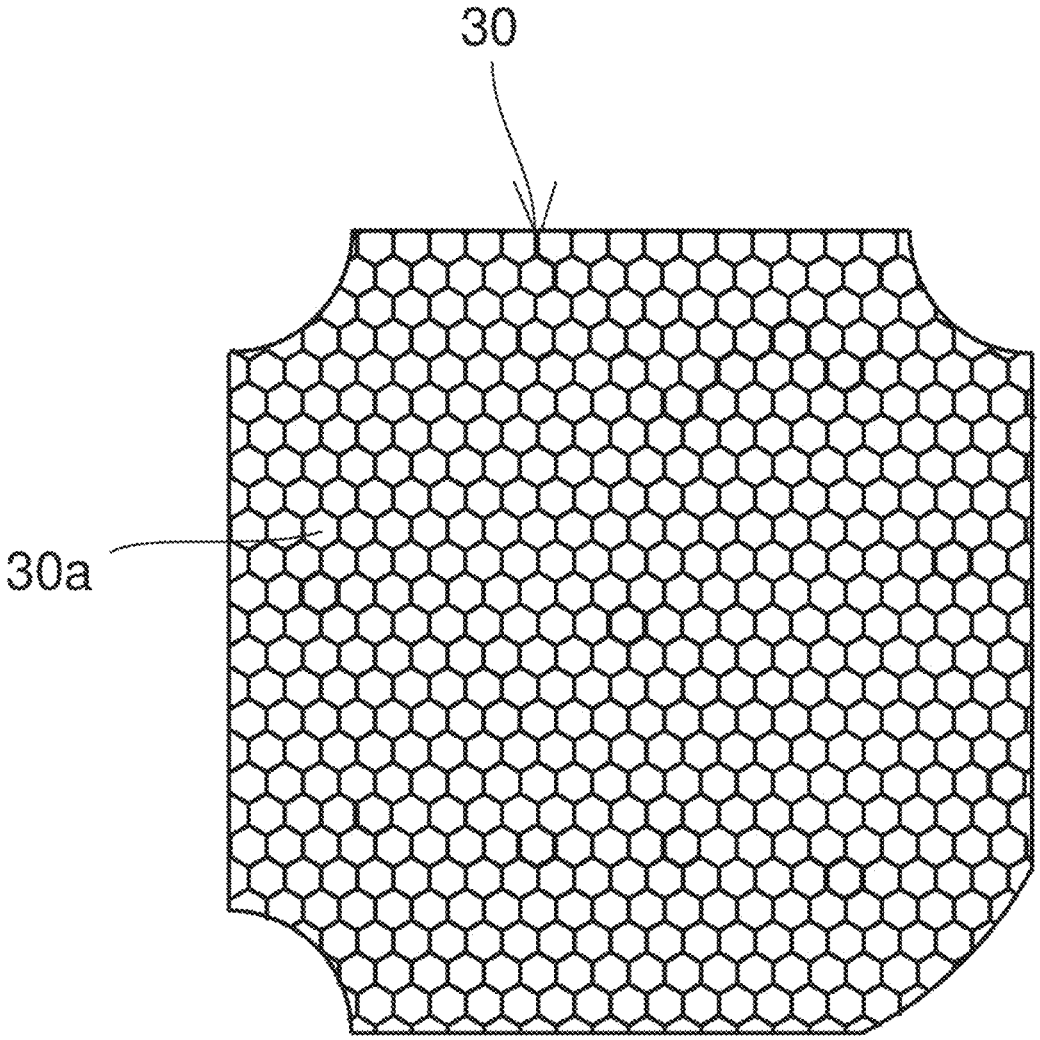
FIG. 3 is a plan view of a straightening grid of the blower according to the first example embodiment of the present disclosure.
Figure 4:
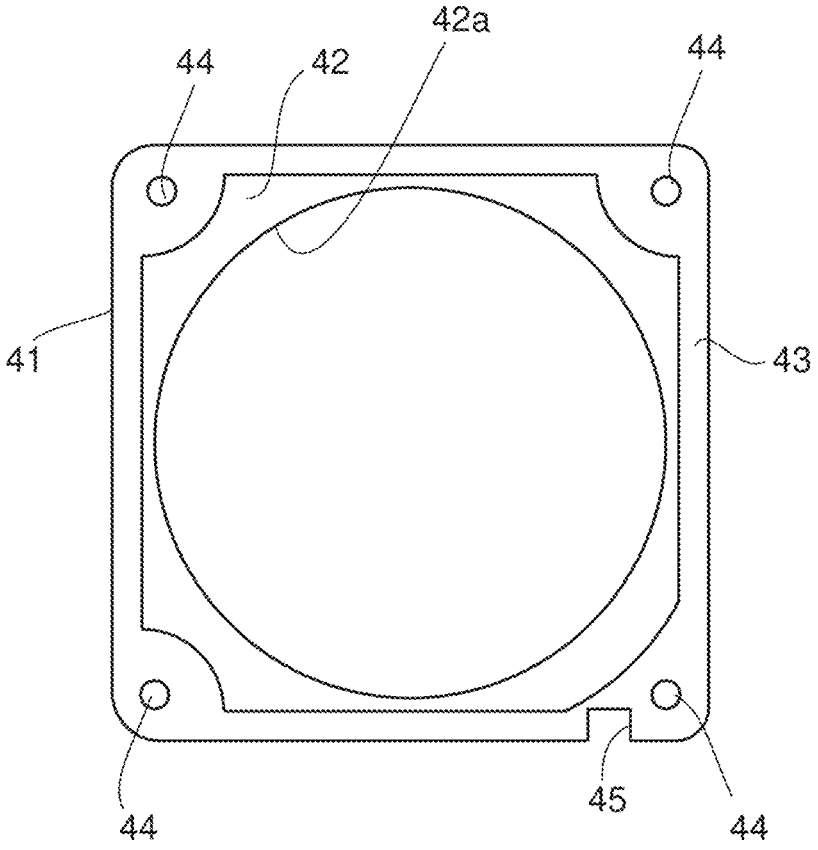
FIG. 4 is a plan view of a clamp of the blower according to the first example embodiment of the present disclosure.

FIG. 3 is a plan view of the straightening grid 30. FIG. 4 is a plan view of the clamp 41, and illustrates a plane that faces the straightening grid 30.

The straightening grid 30 is disposed between the pair of impellers 101, and is formed in a plate shape, by arranging a plurality of ventilation passages 30*a* that has a tubular shape and through which an airflow flows, on a plane that the plurality of ventilation passages 30*a* intersects in the axial direction. The straightening grid 30 is made of aluminum in the present example embodiment, but this example is not restrictive, and the straightening grid 30 may be made of a resin material, another metal material, a ceramic material, or the like.

The straightening grid 30 has a rectangular shape, when viewed in the axial direction, and three corners 31 are recessed radially inward. One corner 31 is convexly curved radially outward to be formed in an arc shape. In the present example embodiment, the straightening grid 30 has a rectangular shape, but may have a polygonal shape or a circular shape.

The ventilation passage 30*a* extends in the axial direction (X1-X2), and has a hexagonal shape, when viewed in the axial direction. Furthermore, the ventilation passages 30*a* have a honeycomb structure by being arranged on a plane orthogonal to the axial direction (X1-X2). By employing the honeycomb structure for the straightening grid 30, rigidity of the straightening grid 30 can be enhanced. In addition, an effect of straightening an airflow delivered from the impeller 101 located on the intake side X2 can be improved, and the flow resistance of the airflow can be reduced. Accordingly, a pressure-air volume characteristic and quietness of the blower 1 can be further improved. Note that the ventilation passage 30*a* may have a polygonal shape or a circular shape other than a hexagonal shape, when viewed in the axial direction.

The clamp 41 includes a support portion 42 having an annular shape, and a peripheral wall 43. The support portion 42 faces the peripheral edge of the straightening grid 30 in the axial direction. In the present example embodiment, the support portion 42 has a plate shape, an inner peripheral edge of the support portion 42 has a circular shape, and the housing 20 has a cylindrical shape. As a result, the airflow that flows in an axial direction X1 can be caused to more smoothly flow.

Furthermore, an inner peripheral surface of the support portion 42 is flush with an inner peripheral surface of the housing 20 (the tubular wall 22) (see FIG. 1). This can prevent the airflow that flows through the blowing flow path 21 in the axial direction X1 from being blocked by the support portion 42. Accordingly, the airflow can be smoothly delivered from the impeller 101 located on the intake side X2 to the straightening grid 30. In addition, the airflow that has been straightened by the straightening grid 30 can be smoothly delivered to the impeller 101 located on the exhaust side X1. This can further improve blowing efficiency and quietness of the blower 1.

Note that the inner peripheral surface of the support portion 42 may be located on a radially outer side of the inner peripheral surface of the housing 20 (the tubular wall 22). This can achieve an advantageous effect that is similar to that in a case where the inner peripheral surface of the support portion 42 is flush with the inner peripheral surface of the housing 20 (the tubular wall 22).

The peripheral wall 43 protrudes in the axial direction (X1-X2) from a peripheral edge of the support portion 42, and surrounds the straightening grid 30 from the radially outer side. In the pair of clamps 41, the peripheral walls 43 come into contact with each other in the axial direction (X1-X2). The straightening grid 30 is housed in a space surrounded by the pair of support portions 42 that face each other in the axial direction (X1-X2) and the pair of peripheral walls 43.

At this time, the peripheral edge of the straightening grid 30 is sandwiched between the pair of support portions 42 in the axial direction, and is surrounded by the pair of peripheral walls 43 from the radially outer side. As a result, the straightening grid 30 is stably held by the pair of clamps 41. At this time, the straightening grid 30 can be easily positioned. In addition, the airflow can be prevented from leaking out from the space surrounded by the pair of support portions 42 and the pair of peripheral walls 43.

In the present example embodiment, the peripheral wall 43 protrudes from each of the pair of support portions 42, but the peripheral wall 43 may protrude from only one of the pair of support portions 42. In this case, the peripheral wall 43 that protrudes from one support portion 42 comes into contact with another support portion 42 that is formed in a flat plate shape.

Furthermore, the pair of clamps 41 include a clamping screw hole 44. The clamping screw hole 44 is in a corner of the peripheral wall 43, and penetrates in the axial direction (X1-X2). In the present example embodiment, the clamping screw hole 44 is in four positions in corners of the peripheral wall 43. The clamping screw hole 44 and a housing screw hole 20*a* are aligned, and are screwed with a screw (not illustrated). As a result, the pair of housings 20 and the pair of clamps 41 are integrally fixed. Accordingly, assembling workability of the blower 1 is further improved.

Note that the peripheral wall 43 is formed to have a great width in the radial direction in the corners. More specifically, in three corners of the peripheral wall 43, an inner peripheral surface protrudes radially inward to be convexly curved. This can prevent the clamp 41 from increasing in size in the radial direction, while securing a region of forming the clamping screw hole 44 in the peripheral wall 43. Note that in one corner of the peripheral wall 43, the inner peripheral surface is recessed to be curved radially outward.

Furthermore, the straightening grid 30 is formed along the inner peripheral surface of the peripheral wall 43, and in three corners of the straightening grid 30, an outer peripheral surface is concavely recessed radially inward. Accordingly, the outer peripheral surface of the straightening grid 30 and the inner peripheral surface of the peripheral wall 43 can be in contact with or close to each other. As a result, in a space surrounded by the pair of clamps 41, the airflow can be prevented from leaking to the periphery of the straightening grid 30. Accordingly, blowing efficiency and quietness can be prevented from deteriorating.

Furthermore, the pair of clamps 41 include a groove 45. The groove 45 is formed by causing the outer peripheral surface of the peripheral wall 43 to be recessed radially inward. The groove 45 and the housing groove 26*b* are disposed to overlap each other in the axial direction. As a result, a lead wire (not illustrated) that is connected to each of the motors 12 is inside the groove 45 and the housing groove 26*b*, and therefore the lead wire can be easily routed. Accordingly, assembling workability of the blower 1 is further improved.

Figure 5:
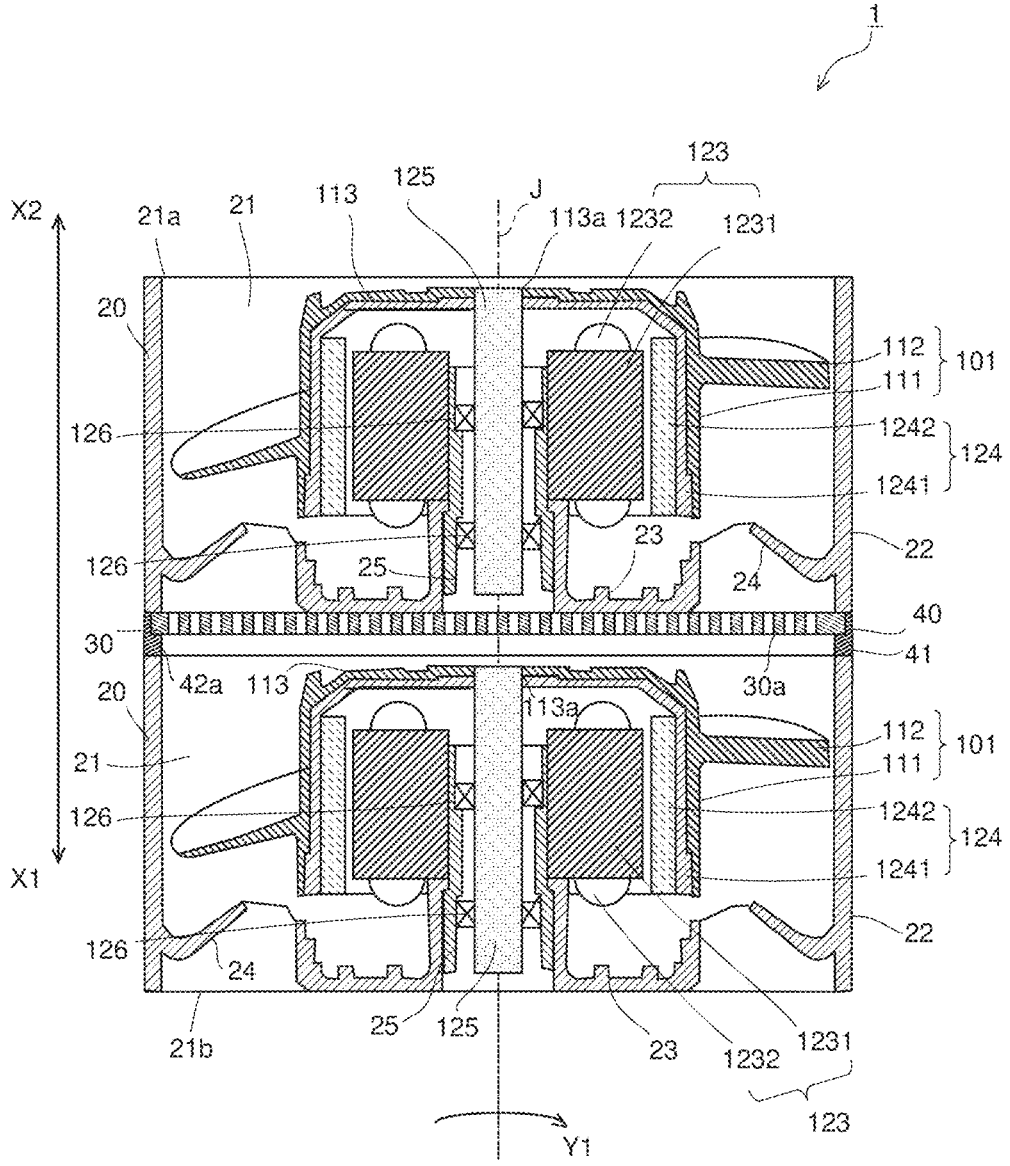
FIG. 5 is a longitudinal sectional view of a blower according to a second example embodiment of the present disclosure.
Figure 6:
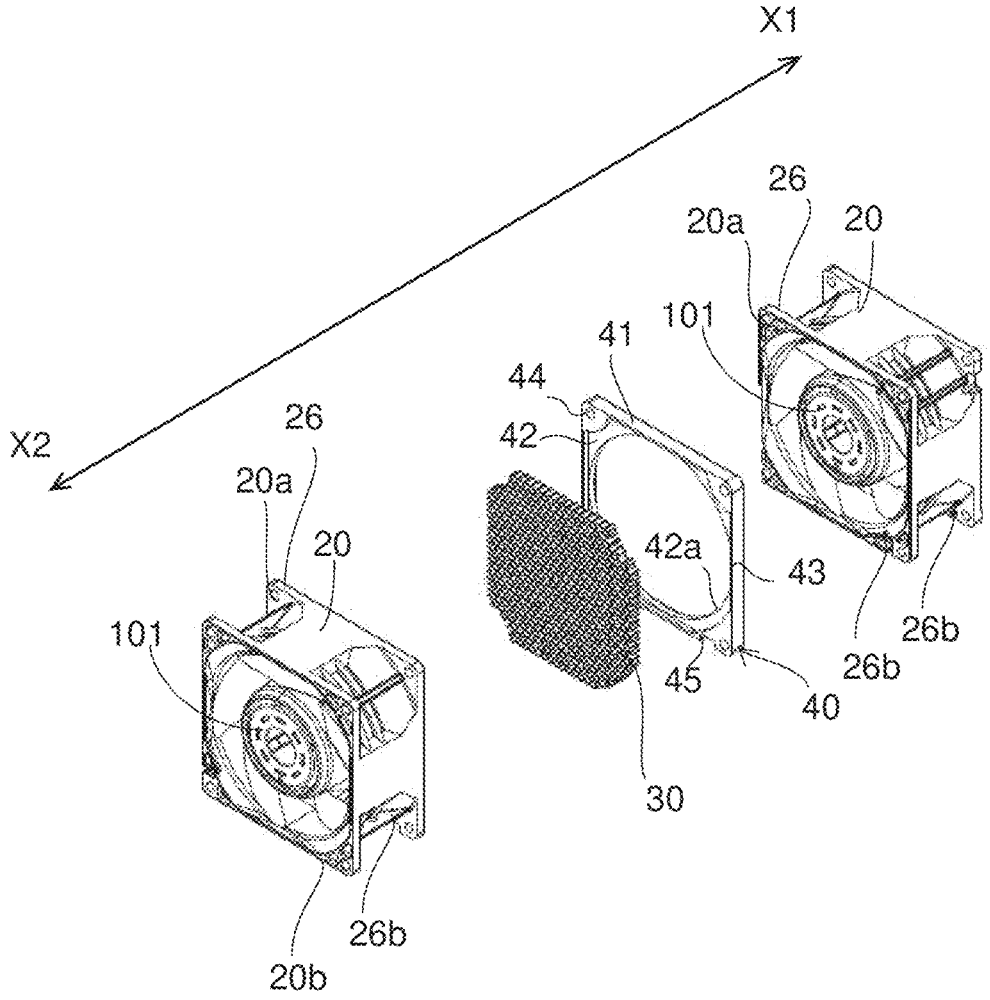
FIG. 6 is an exploded perspective view of the blower according to the second example embodiment of the present disclosure.

Next, a second example embodiment of the present disclosure will be described. FIG. 5 is a longitudinal sectional view of an example of a blower 1 according to the second example embodiment, and FIG. 6 is an exploded perspective view of the blower 1. For convenience of description, portions that are similar to those in the first example embodiment illustrated in FIGS. 1 to 4 described above are denoted by identical reference signs. The second example embodiment is different from the first example embodiment in that the holding portion 40 is constituted by only one clamp 41. In other points, the second example embodiment is similar to the first example embodiment.

In the present example embodiment, the peripheral wall 43 protrudes in an axial direction X2 from the peripheral edge of the support portion 42, and surrounds the straightening grid 30 from the radially outer side. More specifically, the peripheral wall 43 is in contact with the tubular wall 22 of the housing 20 that is disposed on the intake side X2, in the axial direction (X1-X2). As a result, the straightening grid 30 is housed in a space surrounded by the support portion 42 that the straightening grid 30 faces in the axial direction (X1-X2), the tubular wall 22, and the peripheral wall 43. The holding portion 40 is constituted by only one clamp 41, and therefore the number of parts can be reduced, and a cost of manufacturing the blower 1 can be reduced.

In the present example embodiment, the straightening grid 30 is clamped by the housing 20 disposed on the intake side X2 and the clamp 41, but the straightening grid 30 may be clamped by the housing 20 disposed on the exhaust side X1 and the clamp 41.

Figure 7:
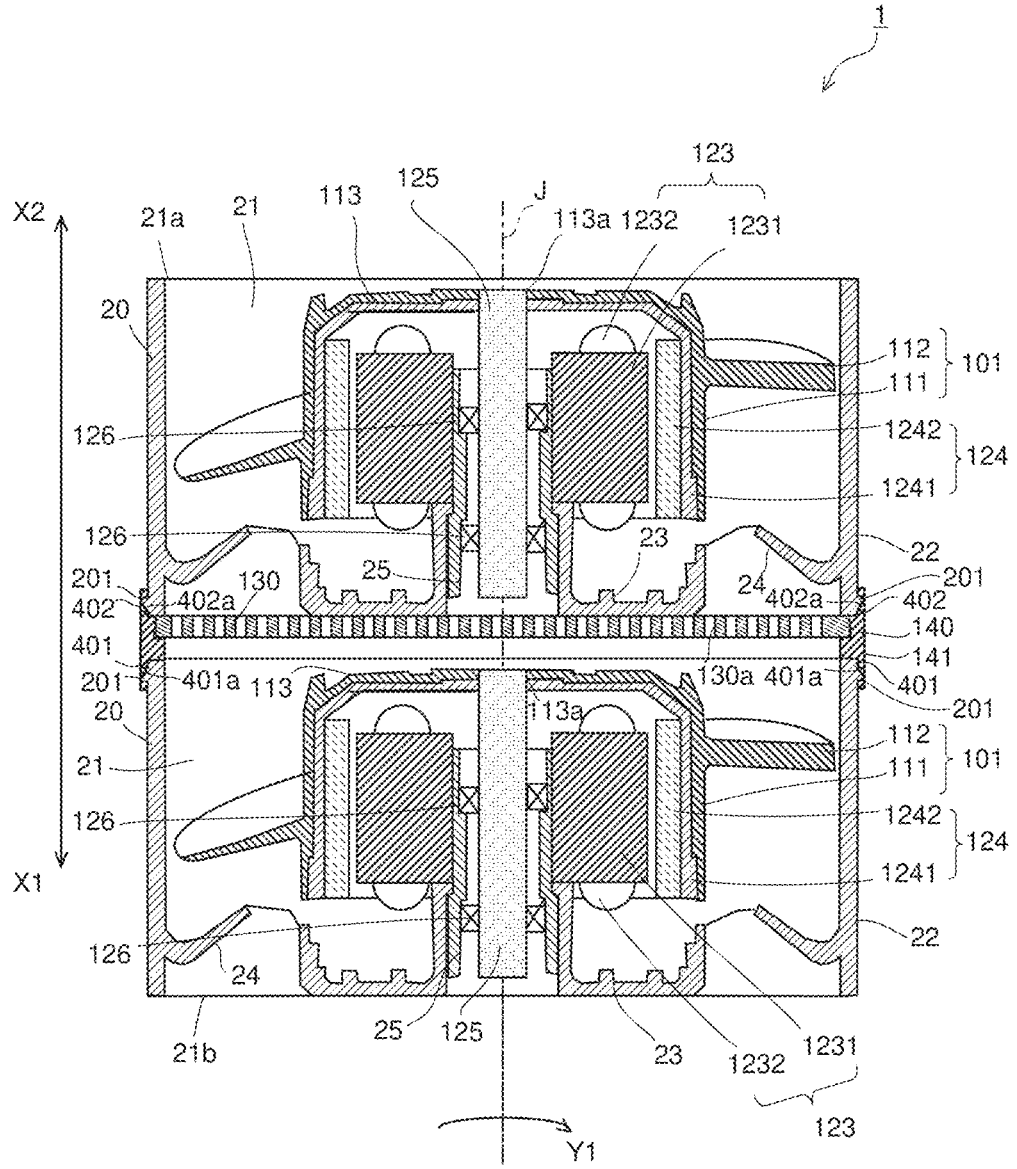
FIG. 7 is a longitudinal sectional view of a blower according to a third example embodiment of the present disclosure.
Figure 8:
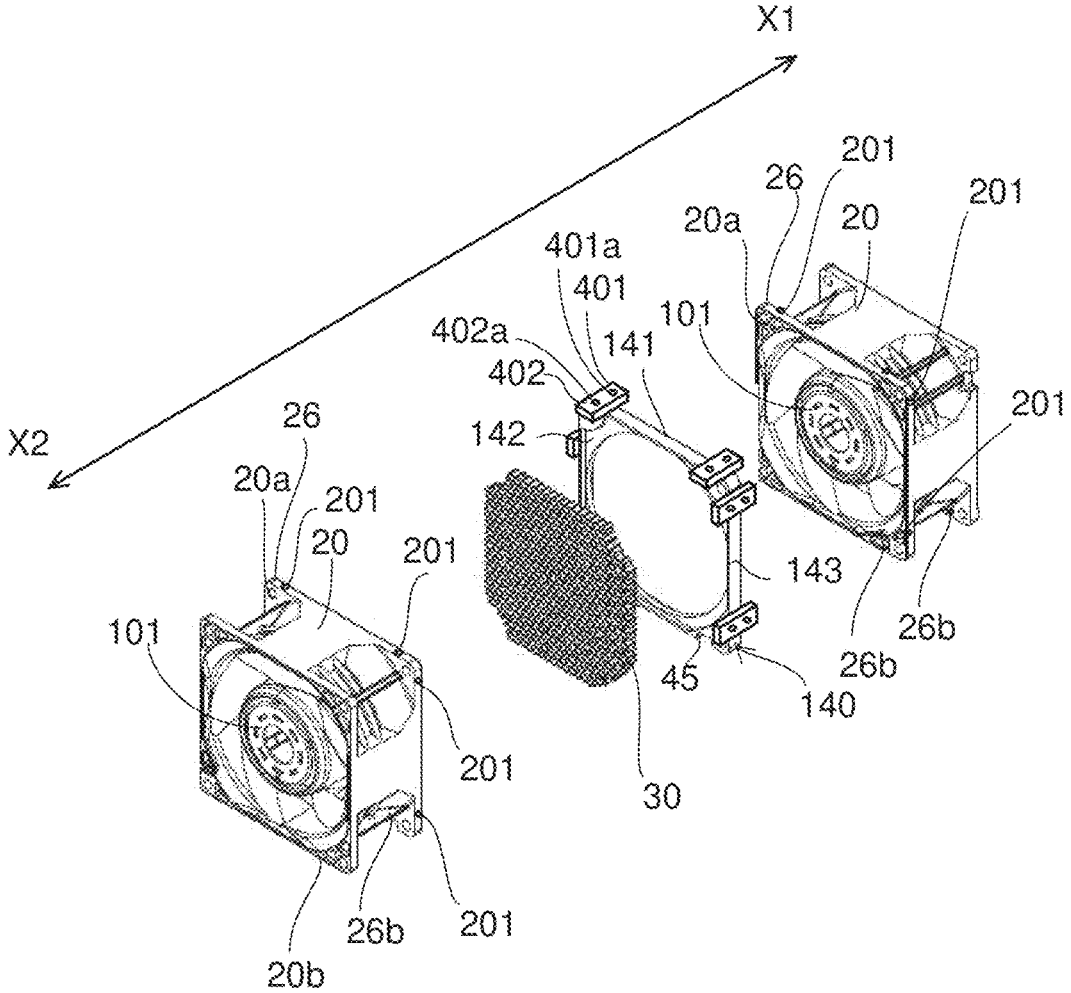
FIG. 8 is an exploded perspective view of the blower according to the third example embodiment of the present disclosure.
Figure 9:
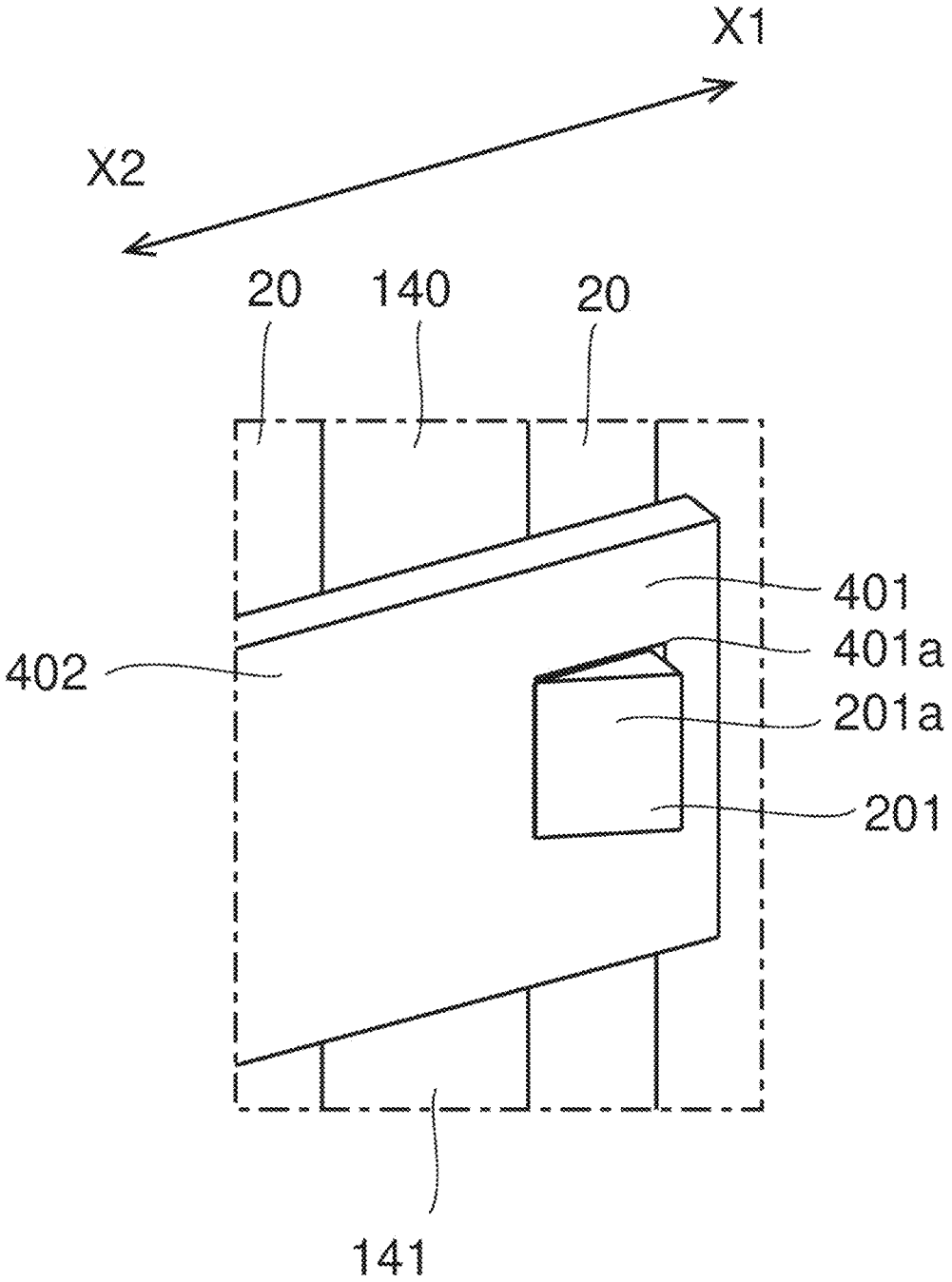
FIG. 9 is a perspective view illustrating a portion of a holding portion of the blower according to the third example embodiment of the present disclosure in an enlarged manner.

Next, a third example embodiment of the present disclosure will be described. FIG. 7 is a longitudinal sectional view of an example of a blower 1 according to the third example embodiment, and FIG. 8 is an exploded perspective view of the blower 1. FIG. 9 is a perspective view illustrating a portion of a holding portion 140 of the blower 1 in an enlarged manner. For convenience of description, portions that are similar to those in the first and second example embodiments illustrated in FIGS. 1 to 6 described above are denoted by identical reference signs. In the third example embodiment, each of the pair of housings 20 has a plurality of engagement male portions (first engagement portions) 201 disposed on a radially outer surface, and the holding portion 140 includes pluralities of engagement claws 401 and 402. In addition, the holding portion 140 includes a holder 141 that holds a peripheral edge of a straightening grid 130.

More specifically, the engagement male portion (the first engagement portion) 201 protrudes in the radial direction from the radially outer surface of the housing 20, and has a protruding shape. The engagement male portion (the first engagement portion) 201 has an inclined surface 201*a* that is inclined radially outward in accordance with protrusion of the engagement claw 401. Furthermore, in the present example embodiment, the engagement male portion (the first engagement portion) 201 is in seven positions in each of the housings 20.

The engagement claw 401 protrudes in the axial direction X1 from a radially outer end of the holding portion 140 (the holder 141), and includes an engagement female portion (a second engagement portion) 401*a* at a distal end. The engagement claw 402 protrudes in the axial direction X2 from the radially outer end of the holding portion 140 (the holder 141), and includes an engagement female portion (a second engagement portion) 402*a* at a distal end.

The engagement female portions 401*a* and 402*a* have a recessed shape that is recessed in the radial direction, and the engagement male portion 201 is disposed therein. The engagement female portions 401*a* and 402*a* engage with the engagement male portion 201. In the present example embodiment, the engagement female portion 401*a* includes a through-hole that penetrates the engagement claw 401 in the radial direction. In addition, the engagement female portion 402*a* includes a through-hole that penetrates the engagement claw 402 in the radial direction.

Note that the engagement female portion 401*a* is not limited to the through-hole, and may be formed by forming a recess on a radially inner surface of the engagement claw 401. In addition, the engagement female portion 402*a* is not limited to the through-hole, and may be formed by forming a recess on a radially inner surface of the engagement claw 402.

In the present example embodiment, the engagement claws 401 and the engagement claws 402 are disposed side by side in the axial direction (X1-X2), and are formed integrally with the holder 141. In addition, the engagement claw 401 and the engagement claw 402 are in seven positions in the holder 141.

In coupling the housing 20 disposed on the exhaust side X1 to the holding portion 140, the housing 20 and the holding portion 140 are brought close to each other, while the distal end of the engagement claw 401 is slid on the inclined surface 201*a*. As a result, the engagement male portion 201 is easily inserted into the engagement female portion 401*a*. Similarly, in coupling the housing 20 disposed on the intake side X2 to the holding portion 140, the housing 20 and the holding portion 140 are brought close to each other, while the distal end of the engagement claw 402 is slid on the inclined surface 201*a*. As a result, the engagement male portion 201 is easily inserted into the engagement female portion 402*a*. Accordingly, assembling workability between the pair of housings 20 and the holding portion 140 is further improved.

In addition, the pair of housings 20 can be coupled and fixed to the holding portion 140 by using a reduced number of parts such as screws. As a result, a cost of manufacturing the blower 1 can be further reduced. Note that the clamping screw hole 44 and the housing screw hole 20*a* can be used not to couple the pair of housings 20 to the holding portion 140 but to fix the blower 1 to a base member (not illustrated).

Figure 10:
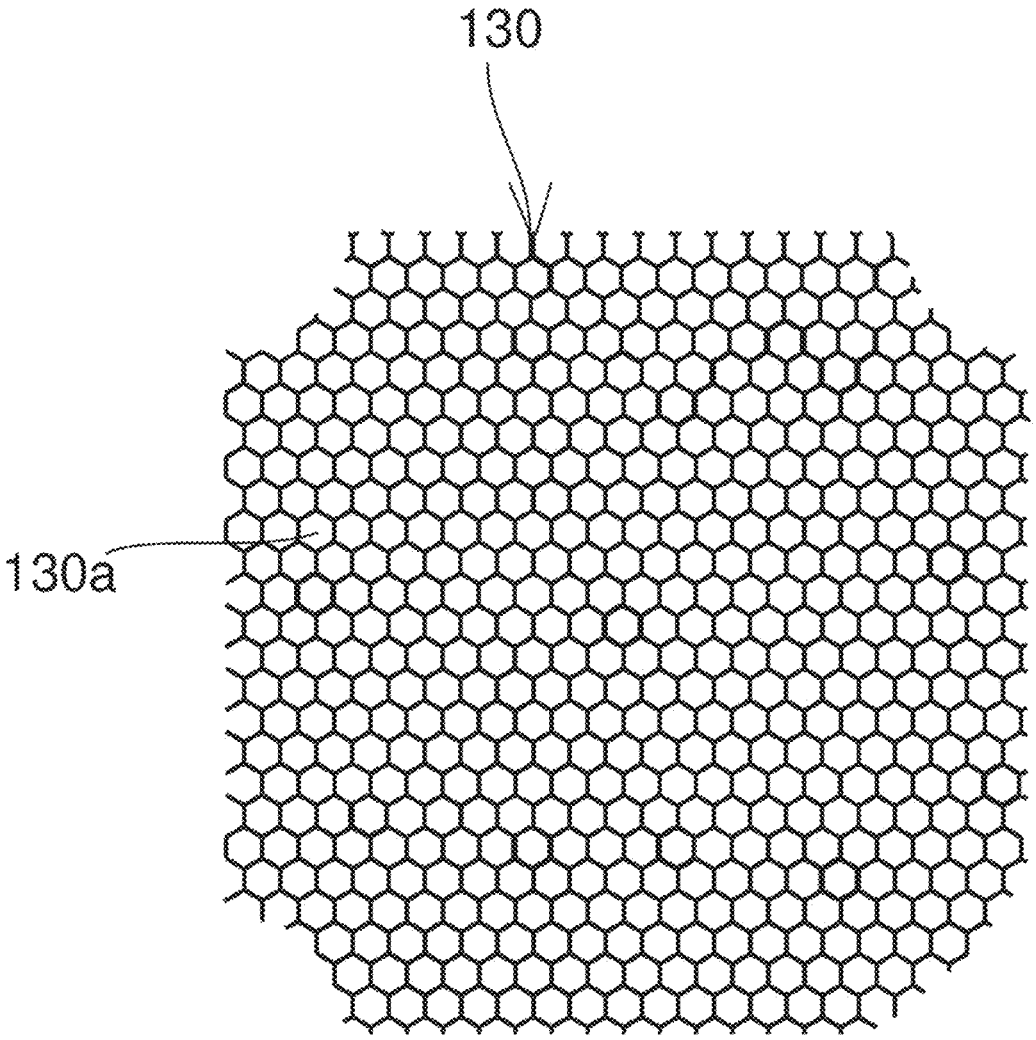
FIG. 10 is a plan view of a straightening grid of the blower according to the third example embodiment of the present disclosure.
Figure 11:
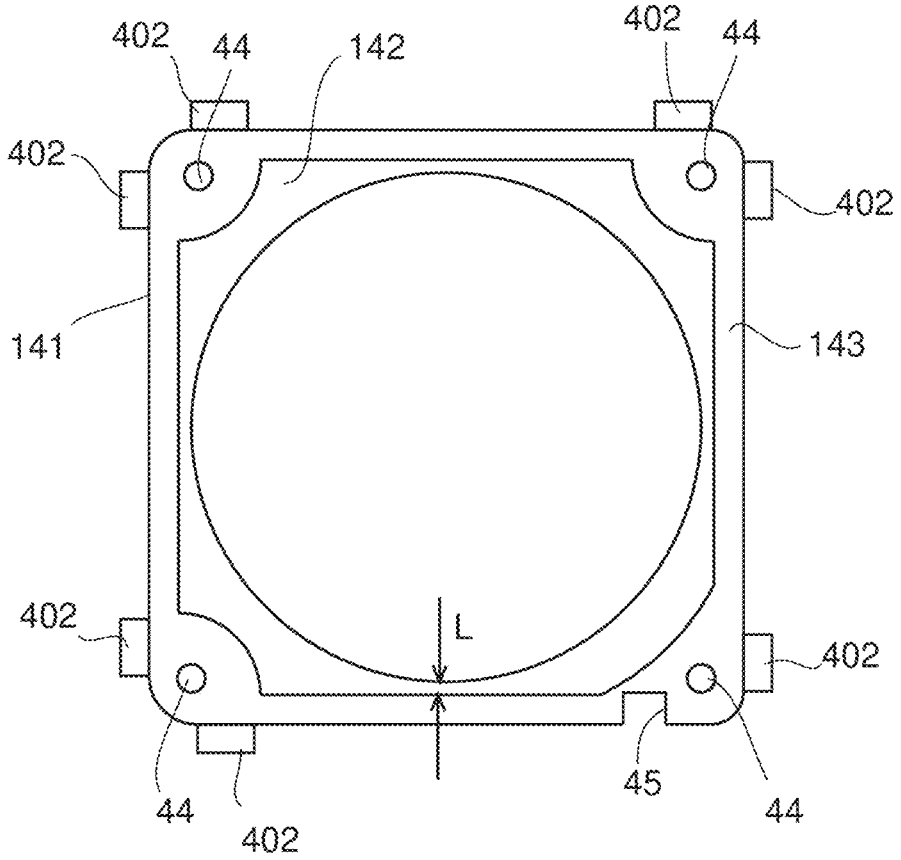
FIG. 11 is a plan view of a holder of the blower according to the third example embodiment of the present disclosure.

FIG. 10 is a plan view of the straightening grid 130. In addition, FIG. 11 is a plan view of the holder 141, and illustrates a plane that faces the straightening grid 130. In the present example embodiment, the holder 141 includes a holding support portion 142 having an annular shape, and a holding peripheral wall 143. The holding support portion 142 faces a peripheral edge of the straightening grid 130 in the axial direction (X1-X2). In the present example embodiment, the holding support portion 142 has a plate shape, an inner peripheral edge of the holding support portion 42 has a circular shape, and the housing 20 has a cylindrical shape.

A minimum distance L in the radial direction between the inner peripheral edge of the holding support portion 142 and an inner peripheral edge of the holding peripheral wall 143 is greater than a thickness in the axial direction (X1-X2) of the straightening grid 130. As a result, the straightening grid 130 is more stably held by the holding portion 140. This can further improve blowing efficiency and quietness of the blower 1.

Furthermore, in the present example embodiment, the holding peripheral wall 143 is constituted by four sides that are orthogonal to each other, when viewed in the axial direction, and each of the sides of the holding peripheral wall 143 is parallel to one side of an inner wall of a ventilation passage 130*a* of the straightening grid 130, when viewed in the axial direction. Stated another way, one side of the holding peripheral wall 143 is parallel to one side of the ventilation passage 130*a*, when viewed in the axial direction. As a result, the straightening grid 130 is more stably held by the holding portion 140. Accordingly, blowing efficiency and quietness of the blower 1 can be further improved.

Note that, in the present example embodiment, in each of the ventilation passages 130*a* in the peripheral edge of the straightening grid 130, a portion of the inner wall is open in the radial direction (see FIG. 10). A portion of the inner wall of each of the ventilation passages 130*a* that are open is covered with the holding peripheral wall 143.

It is preferable that at least a portion of the holder 141 be made of a material that is more elastic than a material of the pair of housings 20. Stated another way, it is preferable that at least a portion of the holding portion 140 be made of a material that is more elastic than a material of the pair of housings 20. By doing this, the vibration of the housing 20 is absorbed by the holding portion 140, and the vibration of the blower 1 can be reduced to further improve quietness.

Figure 12:
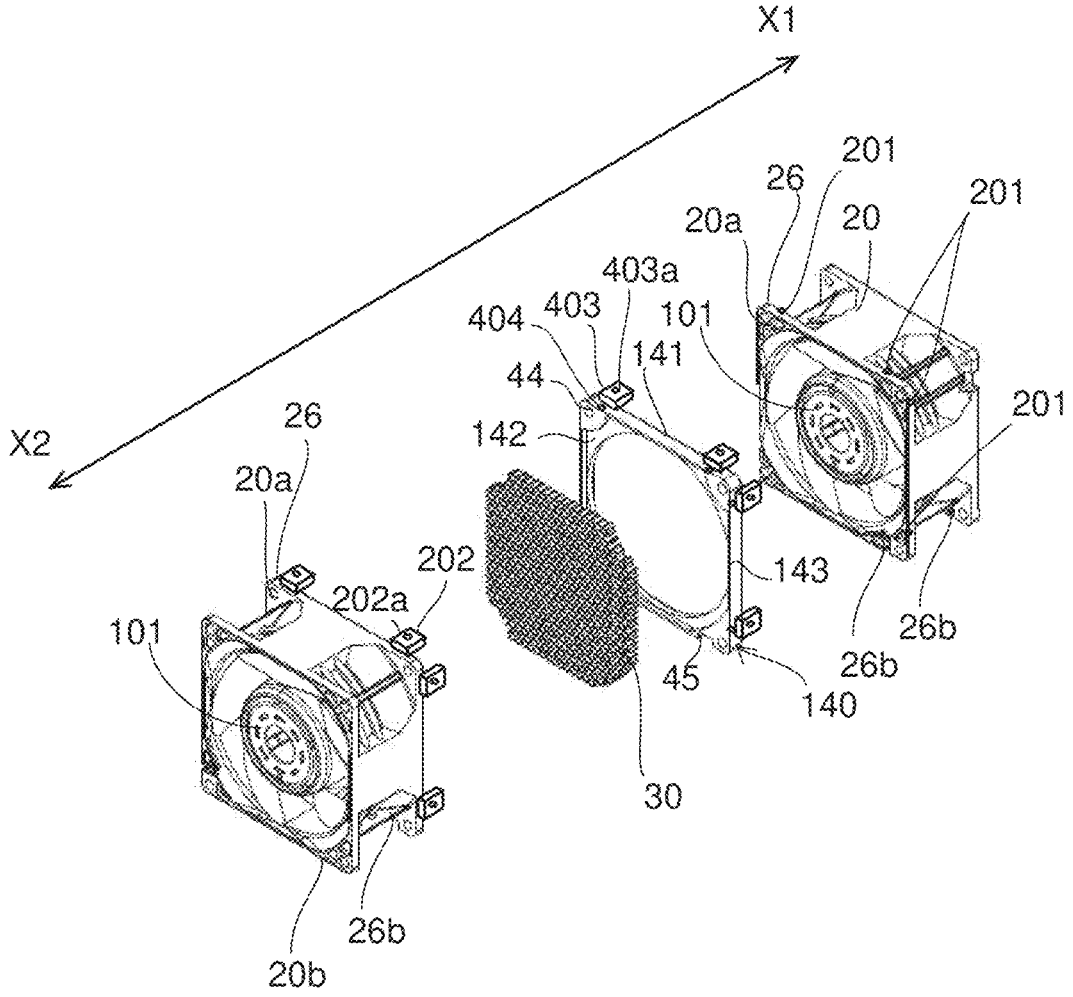
FIG. 12 is an exploded perspective view of a blower according to a fourth example embodiment of the present disclosure.

Next, a fourth example embodiment of the present disclosure will be described. FIG. 12 is an exploded perspective view of a blower 1 according to the fourth example embodiment. For convenience of description, portions that are similar to those in the third example embodiment illustrated in FIGS. 7 to 11 described above are denoted by identical reference signs.

In the fourth example embodiment, the housing 20 disposed on the exhaust side X1 includes a plurality of engagement male portions (first engagement portions) 201 disposed on a radially outer surface, and the housing 20 disposed on the intake side X2 includes a plurality of engagement claws 202. In addition, the holding portion 140 includes an engagement male portion (a first engagement portion) 404 and an engagement claw 403.

The engagement claw 202 protrudes in the axial direction X1 from a radially outer end of the housing 20, and includes, at a distal end, an engagement female portion (a second engagement portion) 202*a* that engages with the engagement male portion (the first engagement portion) 404. The engagement claw 403 protrudes in the axial direction X1 from the radially outer end of the housing 20, and includes, at a distal end, an engagement female portion (a second engagement portion) 403*a* that engages with the engagement male portion (the first engagement portion) 201.

Furthermore, in the present example embodiment, seven engagement claws 202 are in the housing 20, and are formed integrally with the housing 20. The engagement male portion (the first engagement portion) 404 and the engagement claw 403 are disposed side by side in the axial direction (X1-X2), and the engagement male portion (the first engagement portion) 404 is located on the intake side X2 relative to the engagement claw 403. Seven engagement male portions (first engagement portions) 404 and seven engagement claws 403 are in the holder 141, and are formed integrally with the holder 141.

By employing this configuration, the engagement male portion 404 is inserted into the engagement female portion 202*a*, and the housing 20 disposed on the intake side X2 is coupled to the holding portion 140. In addition, the engagement male portion 201 is inserted into the engagement female portion 403*a*, and the holding portion 140 is coupled to the housing 20 disposed on the exhaust side X1. The pair of housings 20 can be coupled and fixed to each other, while clamping the holding portion 140, by using a reduced number of parts such as screws.

Note that the plurality of engagement male portions (first engagement portions) 201 may be in the housing 20 disposed on the intake side X2, and the plurality of engagement claws 202 may be in the housing 20 disposed on the exhaust side X1. In this case, the engagement male portion (the first engagement portion) 404 is disposed on the exhaust side X1 relative to the engagement claw 403.

Stated another way, one of the pair of housings 20 and the holding portion 140 includes the plurality of engagement male portions (first engagement portions) 201 or 404 disposed on the radially outer surface, and another of the pair of housings 20 and the holding portion 140 includes the plurality of engagement claws 202 or 403 that each protrudes in the axial direction from the radially outer end, and each includes, at the distal end, the engagement female portion (the second engagement portion) 202*a* or 403*a* that engages with the engagement male portion (the first engagement portion) 201 or 404.

Figure 13:
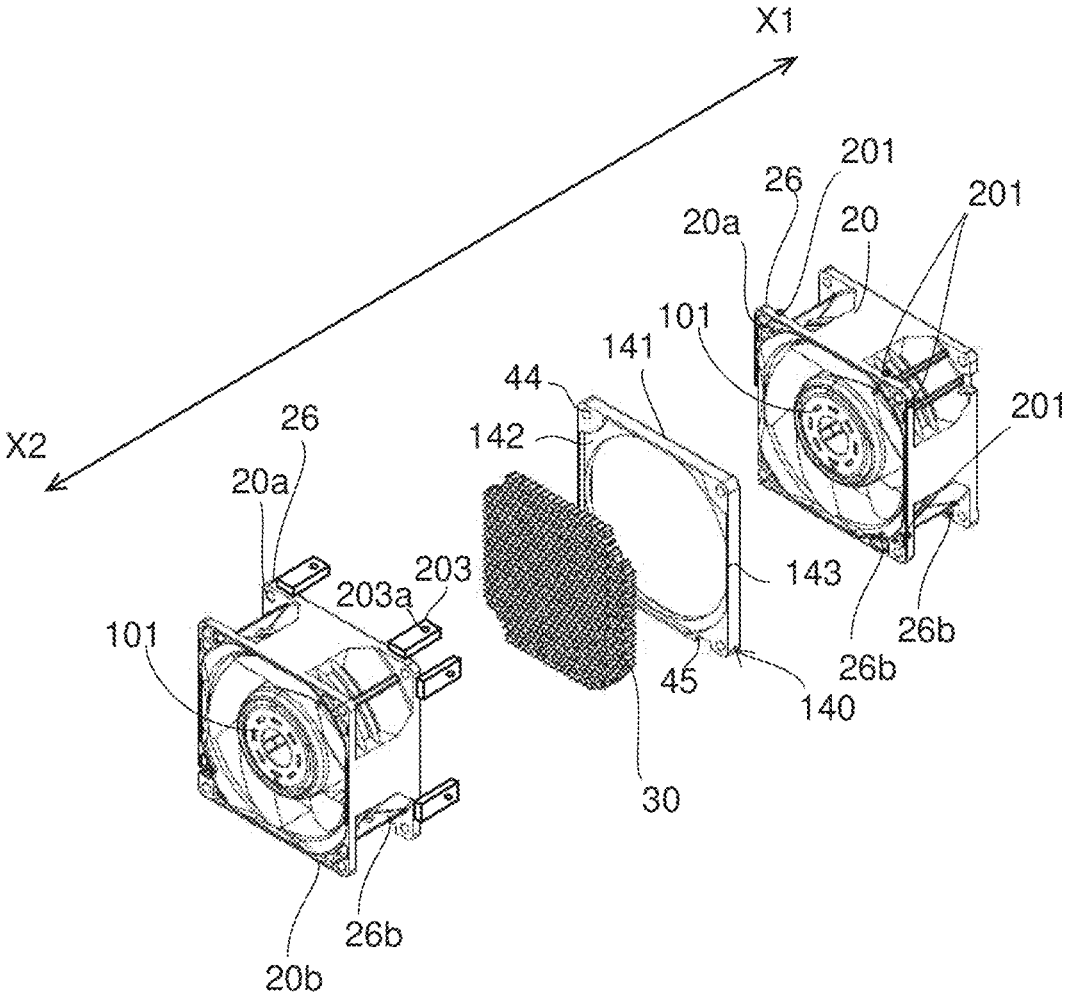
FIG. 13 is an exploded perspective view of a blower according to a fifth example embodiment of the present disclosure.

Next, a fifth example embodiment of the present disclosure will be described. FIG. 13 is an exploded perspective view of a blower 1 according to the fifth example embodiment. For convenience of description, portions that are similar to those in the third and fourth example embodiments illustrated in FIGS. 7 to 12 described above are denoted by identical reference signs.

In the fifth example embodiment, the housing 20 disposed on the exhaust side X1 includes a plurality of engagement male portions (first engagement portions) 201 disposed on a radially outer surface, and the housing 20 disposed on the intake side X2 includes a plurality of engagement claws 203. The engagement claw 203 protrudes in the axial direction X1 from a radially outer end of the housing 20, and includes, at a distal end, an engagement female portion (a second engagement portion) 203*a* that engages with the engagement male portion (the first engagement portion) 201. By employing this configuration, the pair of housings 20 can be coupled and fixed to each other, while clamping the holding portion 140, by using a reduced number of parts such as screws.

Furthermore, in the present example embodiment, seven engagement claws 203 are in the housing 20, and are formed integrally with the housing 20.

The plurality of engagement male portions (first engagement portions) 201 may be in the housing 20 disposed on the intake side X2, and the plurality of engagement claws 203 may be in the housing 20 disposed on the exhaust side X1.

Stated another way, one of the pair of housings 20 includes the plurality of engagement male portions (first engagement portions) 201 disposed on the radially outer surface, and another of the pair of housings 20 incudes the plurality of engagement claws 203 that each protrudes in the axial direction from the radially outer end, and each includes, at the distal end, the engagement female portion (the second engagement portion) 203*a* that engages with the engagement male portion (the first engagement portion) 201.

The example embodiments described above are merely examples of the present disclosure. The configurations of the example embodiments may be appropriately changed without departing from the technical idea of the present disclosure. In addition, the example embodiments may be implemented in combination within a feasible range. For example, in the first to fifth example embodiments, the base 23 is disposed on the exhaust side X1 in each of the housings 20, but each of the bases 23 may be disposed on the intake side X2, and the pair of housings 20 may be coupled to each other.

Furthermore, the bases 23 may be brought into contact with each other, and the pair of housings 20 may be coupled to each other. In addition, the bases 23 may be caused to face each other in the axial direction to sandwich the pair of motors 12, and the pair of housings 20 may be coupled to each other.

Moreover, in the third to fifth example embodiments, the engagement male portions (the first engagement portions) 201 and 404 may be formed into female shapes, the engagement female portions (the second engagement portions) 202*a*, 203*a*, 401*a*, 402*a*, and 403*a* may be formed into male shapes, and the engagement male portions (the first engagement portions) 201 and 404 and the engagement female portions (the second engagement portions) 202*a*, 203*a*, 401*a*, 402*a*, and 403*a* may engage with each other.

As described above, a blower (1) in an example embodiment of the present disclosure includes a pair of impellers (101) rotatable with a central axis (J) as a center, and coaxially or substantially coaxially positioned; a pair of housings (20) extending along the central axis and having a tubular shape with both end surfaces in an axial direction open, the pair of housings respectively housing the pair of impellers; a straightening grid (30) that is between the pair of impellers, and includes a plurality of ventilation passages (30*a*) that have a tubular shape and through which an airflow flows, the plurality of ventilation passages being arranged on a plane that intersects the plurality of ventilation passages in the axial direction; and a holding portion (40) that is between the pair of housings, and holds a peripheral edge of the straightening grid, and the straightening grid and the holding portion are made of different structures (a first configuration).

In the first configuration, one of the pair of housings and the holding portion may include a plurality of first engagement portions (201) on a radially outer surface, and another of the pair of housings and the holding portion may include a plurality of engagement claws (202, 203) that protrude in the axial direction from a radially outer end, and each includes, at a distal end, a second engagement portion (202*a*, 203*a*) that engages with the first engagement portion (a second configuration).

In the first configuration, one of the pair of housings may include a plurality of first engagement portions (201) disposed on a radially outer surface, and another of the pair of housings may include a plurality of engagement claws (203) that each protrudes in the axial direction from a radially outer end, and each includes, at a distal end, a second engagement portion (203*a*) to engage with the first engagement portion (a third configuration).

In any of the first to third configurations, the first engagement portion may protrude in a radial direction, and may have a protruding shape, the second engagement portion may be recessed in the radial direction, and may have a recessed shape, and the first engagement portion may be inside the second engagement portion, and the first engagement portion may include an inclined surface (201*a*) that is inclined radially outward in accordance with protrusion of the engagement claw (a fourth configuration).

In any of the first to fourth configurations, in each of the pair of housings, an internal blowing flow path (3) that opposes the straightening grid may expand radially outward in a portion closer to the straightening grid in the internal blowing flow path (a fifth configuration).

In any of the first to fifth configurations, the holding portion may include a holder (140) to hold the peripheral edge of the straightening grid, the holder may include a holding support portion (142) that has an annular shape, and opposes the peripheral edge of the straightening grid in the axial direction, and a holding peripheral wall (143) that protrudes in the axial direction from a peripheral edge of the holding support portion, and surrounds the straightening grid from a radially outer side, and a minimum distance (L) in a radial direction between an inner peripheral edge of the holding support portion and an inner peripheral edge of the holding peripheral wall may be greater than a thickness in the axial direction of the straightening grid (a sixth configuration).

In any of the first to sixth configurations, in the straightening grid, the plurality of ventilation passages may have a polygonal shape, when viewed in the axial direction, and one side of the holding peripheral wall may be parallel to one side of each of the plurality of ventilation passages, when viewed in the axial direction (a seventh configuration).

In any of the first to seventh configurations, at least a portion of the holding portion may be made of a material that is more elastic than a material of the pair of housings (an eighth configuration).

In any of the first to eighth configurations, the holding portion may include a pair of clamps (41) that clamp the peripheral edge of the straightening grid in the axial direction (a ninth configuration).

In any of the first to ninth configurations, each of the pair of clamps may include a support portion (42) that has an annular shape, and opposes the peripheral edge of the straightening grid in the axial direction (X1-X2), and a peripheral wall (43) that protrudes in the axial direction from a peripheral edge of the support portion, and surrounds the straightening grid from a radially outer side (a tenth configuration).

In any of the first to tenth configurations, an inner peripheral surface of the support portion may be located flush with an inner peripheral surface of each of the pair of housings, or may be located on a radially outer side of the inner peripheral surface of each of the pair of housings (an eleventh configuration).

In any of the first to eleventh configurations, an inner peripheral edge of the support portion may be circular, and an inner peripheral surface of each of the pair of housings may have a cylindrical shape (a twelfth configuration).

In any of the first to twelfth configurations, the pair of housings may each include a housing screw hole (26*a*) that is in a corner, and penetrates in the axial direction, the pair of clamps may each include a clamping screw hole (44) that is in a corner of the peripheral wall, and penetrates in the axial direction, and the pair of housings and the pair of clamps may be screwed by using a screw that is inserted into the housing screw hole and the clamping screw hole (a thirteenth configuration).

In any of the first to thirteenth configurations, in a corner of the straightening grid, an outer peripheral surface may be concavely recessed radially inward, and in a corner of each of the pair of clamps, an inner peripheral surface of the peripheral wall may convexly protrude radially inward (a fourteenth configuration).

In any of the first to fourteenth configurations, each of the pair of clamps may include a groove (45) that is defined by causing an outer peripheral surface of the peripheral wall to be recessed radially inward, and the grooves overlap each other in the axial direction (a fifteenth configuration).

The present disclosure is applicable to, for example, a blower that cools down a server.

Features of the above-described preferred example embodiments and the modifications thereof may be combined appropriately as long as no conflict arises.

While example embodiments of the present disclosure have been described above, it is to be understood that variations and modifications will be apparent to those skilled in the art without departing from the scope and spirit of the present disclosure. The scope of the present disclosure, therefore, is to be determined solely by the following claims.

What is claimed is:

1. A blower comprising:

a pair of impellers rotatable with a central axis as a center, and coaxially or substantially coaxially positioned;

a pair of housings extending along the central axis and having a tubular shape with both end surfaces in an axial direction being open, the pair of housings respectively housing the pair of impellers;

a straightening grid that is between the pair of impellers, and includes a plurality of ventilation passages that have a tubular shape and through which an airflow flows, the plurality of ventilation passages being arranged on a plane that intersects the plurality of ventilation passages in the axial direction; and a holding portion which is defined by a separate independent structure which is provided at a position that is between the pair of housings, and holds a peripheral edge of the straightening grid; wherein the straightening grid and the holding portion are made of different structures; and the holding portion includes a support portion which opposes the peripheral edge of the straightening grid in the axial direction.

2. The blower according to claim 1, wherein one of the pair of housings and the holding portion includes a plurality of first engagement portions on a radially outer surface; and another of the pair of housings and the holding portion includes a plurality of engagement claws that protrude in the axial direction from a radially outer end, and each includes, at a distal end, a second engagement portion to engage with the first engagement portion.

3. The blower according to claim 1, wherein one of the pair of housings includes a plurality of first engagement portions on a radially outer surface, and another of the pair of housings includes a plurality of engagement claws that each protrudes in the axial direction from a radially outer end, and each includes, at a distal end, a second engagement portion to engage with the first engagement portion.

4. The blower according to claim 2, wherein the first engagement portion protrudes in a radial direction, and has a protruding shape;

the second engagement portion is recessed in the radial direction, and has a recessed shape, and the first engagement portion is inside the second engagement portion; and the first engagement portion includes an inclined surface that is inclined radially outward in accordance with protrusion of the engagement claw.

5. The blower according to claim 1, wherein in each of the pair of housings, an internal blowing flow path that opposes the straightening grid expands radially outward in a portion closer to the straightening grid in the internal blowing flow path.

6. The blower according to claim 1, wherein the holding portion includes a holder to hold the peripheral edge of the straightening grid;

the holder includes:

a holding support portion that has an annular shape, and opposes the peripheral edge of the straightening grid in the axial direction; and a holding peripheral wall that protrudes in the axial direction from a peripheral edge of the holding support portion, and surrounds the straightening grid from a radially outer side; and a minimum distance in a radial direction between an inner peripheral edge of the holding support portion and an inner peripheral edge of the holding peripheral wall is greater than a thickness in the axial direction of the straightening grid.

7. The blower according to claim 6, wherein in the straightening grid, the plurality of ventilation passages has a polygonal shape, when viewed in the axial direction; and one side of the holding peripheral wall is parallel or substantially parallel to one side of each of the plurality of ventilation passages, when viewed in the axial direction.

8. The blower according to claim 1, wherein at least a portion of the holding portion is made of a material that is more elastic than a material of the pair of housings.

9. The blower according to claim 1, wherein the holding portion includes a pair of clamps to clamp the peripheral edge of the straightening grid in the axial direction.

10. The blower according to claim 9, wherein each of the pair of clamps includes:

the support portion, which that has an annular shape, and opposes the peripheral edge of the straightening grid in the axial direction; and a peripheral wall that protrudes in the axial direction from a peripheral edge of the support portion, and surrounds the straightening grid from a radially outer side.

11. The blower according to claim 10, wherein an inner peripheral surface of the support portion is located flush with an inner peripheral surface of each of the pair of housings, or is located on a radially outer side of the inner peripheral surface of each of the pair of housings.

12. The blower according to claim 11, wherein an inner peripheral edge of the support portion is circular; and each of the pair of housings has a cylindrical shape.

13. The blower according to claim 10, wherein the pair of housings each include a housing screw hole that is in a corner, and penetrates in the axial direction;

the pair of clamps each include a clamping screw hole that is in a corner of the peripheral wall, and penetrates in the axial direction; and the pair of housings and the pair of clamps are screwed by using a screw that is inserted into the housing screw hole and the clamping screw hole.

14. The blower according to claim 13, wherein in a corner of the straightening grid, an outer peripheral surface is concavely recessed radially inward; and in a corner of each of the pair of clamps, an inner peripheral surface of the peripheral wall convexly protrudes radially inward.

15. The blower according to claim 10, wherein each of the pair of clamps includes a groove that is defined by a recessed radially inward portion of an outer peripheral surface of the peripheral wall; and a plurality of the grooves overlap each other in the axial direction.

* * * * *